US010579004B2

(12) United States Patent
Kurihara et al.

(10) Patent No.: US 10,579,004 B2
(45) Date of Patent: Mar. 3, 2020

(54) BINDING APPARATUS AND IMAGE PROCESSING APPARATUS

(71) Applicant: FUJI XEROX CO., LTD., Tokyo (JP)

(72) Inventors: Satoshi Kurihara, Yokohama (JP); Yutaka Nobe, Yokohama (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 16/219,352

(22) Filed: Dec. 13, 2018

(65) Prior Publication Data

US 2019/0113876 A1 Apr. 18, 2019

Related U.S. Application Data

(63) Continuation of application No. PCT/JP2017/010451, filed on Mar. 15, 2017.

(30) Foreign Application Priority Data

Jul. 14, 2016 (JP) ..... 2016-139807
Jul. 14, 2016 (JP) ..... 2016-139808
(Continued)

(51) Int. Cl.
*B31F 5/02* (2006.01)
*G03G 15/00* (2006.01)
(Continued)

(52) U.S. Cl.
CPC ..... *G03G 15/6544* (2013.01); *B31F 5/02* (2013.01); *B42B 5/00* (2013.01); *B65H 37/04* (2013.01);
(Continued)

(58) Field of Classification Search
CPC ..... B65H 37/04; B65H 2301/43828; B65H 2301/51616; B65H 2408/1222; B31F 1/07;
(Continued)

(56) References Cited

U.S. PATENT DOCUMENTS 5,713,674 A 2/1998 Nakayama et al.
5,846,007 A 12/1998 Nakayama et al.
(Continued)

FOREIGN PATENT DOCUMENTS

CN 1138310 A 12/1996
CN 1624595 A 6/2005
(Continued)

OTHER PUBLICATIONS

May 30, 2017 Search Report issued in International Patent Application No. PCT/JP2017/010451.
(Continued)

*Primary Examiner* — Leslie A Nicholson, III
(74) *Attorney, Agent, or Firm* — Oliff PLC

(57) ABSTRACT

A binding unit includes a first pressing part that presses a recording material bundle to bind the recording material bundle, a second pressing part that faces the first pressing part, and a pushout part that pushes out the second pressing part toward the first pressing part by acting on the second pressing part using an upper shaft lever and by varying a distance from a start portion serving as a start point of pushout movement to the upper shaft lever. The start portion is formed integrally with a member at which the first pressing part is formed.

8 Claims, 11 Drawing Sheets

(30) Foreign Application Priority Data

Jul. 14, 2016 (JP) ..... 2016-139809
Jul. 14, 2016 (JP) ..... 2016-139810

(51) Int. Cl.
*B42B 5/00* (2006.01)
*B65H 37/04* (2006.01)

(52) U.S. Cl.
CPC ... *B65H 2403/514* (2013.01); *G03G 15/6529* (2013.01); *G03G 15/6582* (2013.01); *G03G 2215/00848* (2013.01)

(58) Field of Classification Search
CPC ..... B31F 2201/0707; B31F 2201/0754; G03G 15/6544; G03G 2215/00852
USPC ..... 270/58.08
See application file for complete search history.

(56) References Cited

U.S. PATENT DOCUMENTS

| | | | | |
|---|---|---|---|---|
| 5,848,847 | A | 12/1998 | Nakayama et al. | |
| 5,882,129 | A | 3/1999 | Nakayama | |
| 5,915,862 | A | 6/1999 | Shimono et al. | |
| 5,993,085 | A | 11/1999 | Nakayama et al. | |
| 6,022,015 | A | 2/2000 | Matsumoto | |
| 6,089,564 | A | 7/2000 | Matsumoto et al. | |
| 6,224,051 | B1 | 5/2001 | Nakayama et al. | |
| 6,450,934 | B1 | 9/2002 | Coombs | |
| 6,948,224 | B2 | 9/2005 | Coombs et al. | |
| 8,191,884 | B2 | 6/2012 | Sato et al. | |
| 8,983,362 | B2 * | 3/2015 | Nakamura | B65H 37/04 270/58.08 |
| 8,991,808 | B2 | 3/2015 | Suzuki et al. | |
| 9,315,356 | B2 * | 4/2016 | Yoshida | G03G 15/6544 |
| 9,440,478 | B2 * | 9/2016 | Takahashi | B42B 5/00 |
| 9,751,276 | B2 | 9/2017 | Kamiya et al. | |
| 10,053,324 | B2 | 8/2018 | Abe | |
| 10,093,121 | B2 | 10/2018 | Nobe et al. | |
| 10,173,387 | B2 | 1/2019 | Nobe et al. | |
| 2005/0133991 | A1 | 6/2005 | Ata et al. | |
| 2007/0158894 | A1 | 7/2007 | Hasegawa | |
| 2008/0265484 | A1 | 10/2008 | Fukasawa et al. | |
| 2014/0339754 | A1 | 11/2014 | Abe et al. | |
| 2015/0003938 | A1 | 1/2015 | Morinaga et al. | |
| 2015/0014384 | A1 | 1/2015 | Obuchi et al. | |
| 2015/0093214 | A1 | 4/2015 | Takahashi et al. | |
| 2015/0283783 | A1 * | 10/2015 | Kamiya | B31F 5/02 412/11 |
| 2015/0368062 | A1 | 12/2015 | Saito | |
| 2016/0185149 | A1 | 6/2016 | Kenjo | |
| 2017/0160691 | A1 | 6/2017 | Obuchi et al. | |
| 2017/0274617 | A1 * | 9/2017 | Makita | B31F 5/02 |
| 2018/0015769 | A1 | 1/2018 | Nobe et al. | |
| 2018/0016110 | A1 | 1/2018 | Nobe et al. | |
| 2018/0017927 | A1 | 1/2018 | Nobe et al. | |
| 2018/0281501 | A1 | 10/2018 | Awano et al. | |
| 2018/0321626 | A1 | 11/2018 | Obuchi et al. | |

FOREIGN PATENT DOCUMENTS

| | | | |
|---|---|---|---|
| CN | 1914108 | A | 2/2007 |
| CN | 101293607 | A | 10/2008 |
| CN | 104276438 | A | 1/2015 |
| FR | 396544 | A | 4/1909 |
| JP | H07-047783 | A | 2/1995 |
| JP | 2001-106423 | A | 4/2001 |
| JP | 2010-189101 | A | 9/2010 |
| JP | 2011-201669 | A | 10/2011 |
| JP | 2014-043339 | A | 3/2014 |
| JP | 5447075 | B2 | 3/2014 |
| JP | 2014-105071 | A | 6/2014 |
| JP | 2014-226799 | A | 12/2014 |
| JP | 2015-009525 | A | 1/2015 |
| JP | 2015-054759 | A | 3/2015 |
| JP | 2015-067407 | A | 4/2015 |
| JP | 2016-003118 | A | 1/2016 |
| JP | 2016-016973 | A | 2/2016 |

OTHER PUBLICATIONS

Jun. 6, 2017 Search Report issued in International Patent Application No. PCT/JP2017/011054.
May 30, 2017 Search Report issued in International Patent Application No. PCT/JP2017/012141.
Jun. 13, 2017 Search Report issued in International Patent Application No. PCT/JP2017/012459.
Oct. 4, 2016 Office Action issued in Japanese Patent Application No. 2016-139807.
Feb. 7, 2017 Office Action issued in Japanese Patent Application No. 2016-139807.
Jul. 4, 2017 Office Action issued in Japanese Patent Application No. 2016-139807.
Oct. 4, 2016 Office Action issued in Japanese Patent Application No. 2016-139808.
Feb. 7, 2017 Office Action issued in Japanese Patent Application No. 2016-139808.
Oct. 4, 2016 Office Action issued in Japanese Patent Application No. 2016-139809.
Feb. 7, 2017 Office Action issued in Japanese Patent Application No. 2016-139809.
Jul. 4, 2017 Office Action issued in Japanese Patent Application No. 2016-139809.
Oct. 4, 2016 Office Action issued in Japanese Patent Application No. 2016-139810.
U.S. Appl. No. 16/218,947, filed Dec. 13, 2018 in the name of Kurihara et al.
U.S. Appl. No. 16/218,654, filed Dec. 13, 2018 in the name of Nobe et al.
U.S. Appl. No. 16/219,357, filed Dec. 13, 2018 in the name of Nobe et al.
May 30, 2017 Written Opinion of the Searching Authority issued in International Patent Application No. PCT/JP2017/010451.
Jun. 6, 2017 Written Opinion of the Searching Authority issued in International Patent Application No. PCT/JP2017/011054.
May 30, 2017 Written Opinion of the Searching Authority issued in International Patent Application No. PCT/JP2017/012141.
Jun. 13, 2017 Written Opinion of the Searching Authority issued in International Patent Application No. PCT/JP2017/012459.
Jun. 28, 2019 Office Action Issued for U.S. Appl. No. 16/218,654.
Oct. 2, 2019 Office Action issued in U.S. Appl. No. 16/218,947.
Nov. 4, 2019 Office Action issued in Chinese Patent Application No. 201780043124.X. X.
Nov. 5, 2019 Office Action issued in Chinese Patent Application No. 201780043131.X. 0.
Dec. 11, 2019 Office Action issued in U.S. Appl. No. 16/219,357.

* cited by examiner

BINDING APPARATUS AND IMAGE PROCESSING APPARATUS

CROSS REFERENCE TO RELATED APPLICATION

This is a continuation of International Application No. PCT/JP2017/010451 filed on Mar. 15, 2017, and claims priority from Japanese Patent Application No. 2016-139807 filed on Jul. 14, 2016, Japanese Patent Application No. 2016-139808 filed on Jul. 14, 2016, Japanese Patent Application No. 2016-139809 filed on Jul. 14, 2016, and Japanese Patent Application No. 2016-139810 filed on Jul. 14, 2016.

BACKGROUND

Technical Field

The invention relates to a binding apparatus and an image processing apparatus.

Related Art

JP-A-2015-67407 discloses a sheet binding apparatus in which, in order to suppress sticking of a sheet bundle subjected to crimp binding to a movable crimping member, a separating means capable of coming into contact with the sheet bundle when the movable crimping member moves from a binding position to a retreat position to separate the sheet bundle from the movable crimping member is provided in the movable range of the movable crimping member.

Also, JP-A-2010-189101 discloses a sheet binding apparatus which binds a sheet bundle in such a manner that concavities and convexities are formed on the sheet bundle in the thickness direction. This sheet binding apparatus, in order to perform a binding processing corresponding to the thickness of the sheet bundle, includes a pair of tooth form members movable in the thickness direction of the sheet bundle for sandwiching the sheet bundle to form concavities and convexities on the sheet bundle in the thickness direction, and a pressing force applying mechanism for applying a pressing force to the pair of tooth form members so as to form concavities and convexities and bind the sheet bundle. This pressing force applying mechanism increases the pressing force to be applied to the pair of tooth form members as the thickness of the sheet bundle to be bound increases.

Further, JP-A-2016-3118 discloses a crimp binding means for crimping and binding sheets by a pair of uneven-shaped pressuring surfaces capable of meshing with each other in FIG. 5. In this crimp binding means, the pair of upper and lower pressurizing surfaces are supported by their associated pressurizing members (a fixing side pressurizing member and a movable side pressurizing member) and are moved from their mutually separated wait positions to their operating positions. A cam member is arranged in the movable side pressurizing member and, under the control of rotation of a drive motor connected to the cam member, the pressurizing surface is reciprocated between the wait and operating positions. As a control means controls the rotation angle of the cam member, the pressuring force acting on the pressurizing surfaces is adjusted to be strong or weak.

SUMMARY

In a binding apparatus including a pair of pressing parts having a first pressing portion and a second pressing portion, when a large pressing force is required by employing a pushout structure for pushing out the second pressing portion toward the first pressing portion, the large pressing force by the pushout structure cannot be obtained unless the first pressing portion has sufficient strength.

Aspect of non-limiting embodiments of the present disclosure relates to obtain a large pressing force by a pushout structure when compared with an apparatus configured such that a member in which a first pressing part is formed and a member for supporting a pushout structure for pushing out a second pressing part toward a first pressing part are formed separately from each other.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a binding apparatus including: a first pressing part that presses a recording material bundle for binding the recording material bundle; a second pressing part that faces the first pressing part; and a pushout part that pushes out the second pressing part toward the first pressing part by acting on the second pressing part at a point of action and by varying a distance from a start portion serving as a start point of pushout movement to the point of action, wherein the start portion is formed integrally with a member at which the first pressing part is formed.

BRIEF DESCRIPTION OF THE DRAWINGS

Exemplary embodiment(s) of the present invention will be described in detail based on the following figures, wherein.

DETAILED DESCRIPTION

Hereinafter, description is given below specifically of exemplary embodiments according to the invention with reference to the accompanying drawings.

<Recording Material Processing System 500>

Figure 1:
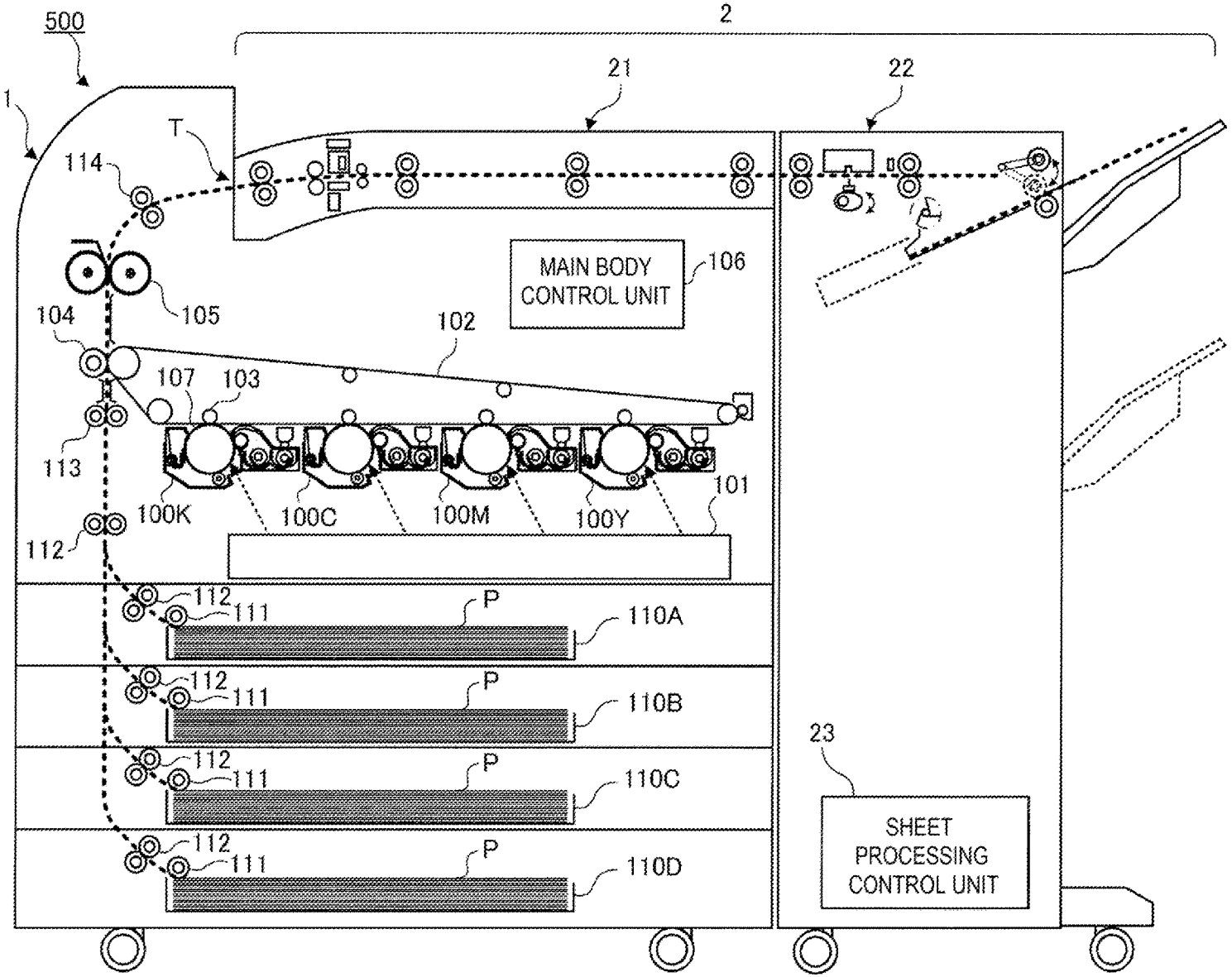
FIG. 1 is a view showing a configuration of a recording material processing system to which an exemplary embodiment is applied.

FIG. 1 is a view showing a configuration of a recording material processing system 500 to which the present exemplary embodiment is applied.

The recording material processing system 500 functioning as one of image processing apparatuses includes an image forming apparatus 1 for forming images on recording materials (sheets) such as sheets P with an image forming part using electrophotography or the like, and a post processing apparatus 2 for post processing multiple sheets P on which images have been formed by the image forming apparatus 1. Here, the image forming apparatus 1 or the post processing apparatus 2 functions as an example of the image processing apparatus as a single unit.

<Image Forming Apparatus 1>

The image forming apparatus 1 includes four image forming units 100Y, 100M, 100C and 100K (also collectively referred to as "an image forming unit 100") for forming images based on the respective color image data. The image forming apparatus 1 also includes a laser exposure device 101 which exposes a photosensitive drum 107 provided in each imaging unit 100 to form electrostatic latent images on the surface of the photosensitive drum 107.

Also, the image forming apparatus 1 includes an intermediate transfer belt 102 to which toner images of the respective colors formed by the respective image forming units 100 are multi-transferred, and a primary transfer roll 103 for sequentially transferring (primarily transferring) the respective color toner images formed in the respective image forming units 100 to the intermediate transfer belt 102. Further, the image forming apparatus 1 includes a secondary transfer roll 104 for collectively transferring (secondarily transferring) the color toner images transferred onto the intermediate transfer belt 102 to the sheets P, a fixing device 105 for fixing the secondarily transferred color toner images on the sheets P, and a main body control unit 106 for controlling the operation of the image forming apparatus 1.

In each image forming unit 100, the photosensitive drum 107 is charged and the electrostatic latent images is formed onto the photosensitive drum 107. And, the electrostatic latent images are developed, and the respective color toner images are formed on the surfaces of the photosensitive drums 107.

The respective color toner images formed on the surfaces of the photosensitive drums 107 are sequentially transferred onto the intermediate transfer belt 102 by the primary transfer rolls 103. And, with the movement of the intermediate transfer belt 102, the respective color toner images are transported to a position where the secondary transfer roll 104 is arranged.

In sheet accommodating parts 110A to 110D of the image forming apparatus 1, different sizes and different kinds of sheets P are accommodated. And, the sheets P are taken out from the sheet accommodating part 110A by a pickup roll 111, for example, and are transported to resist rolls 113 by transport rolls 112.

And, in accordance with the timing at which the respective color toner images on the intermediate transfer belt 102 are transported to the secondary transfer rolls 104, the sheets P are supplied from the resist rolls 113 to a facing part (a secondary transfer part) where the secondary transfer rolls 104 and intermediate transfer belt 102 face each other.

Then, the respective color toner images on the intermediate transfer belt 102 are electrostatically transferred (secondarily transferred) collectively onto the sheets P due to the action of a transfer electric field formed by the secondary transfer rolls 104.

After then, the sheets P with the respective color toner images transferred thereon are peeled off from the intermediate transfer belt 102 and are transported to the fixing devices 105. In the fixing devices 105, the respective color toner images are fixed onto the sheets P with a fixing process using heat and pressure, thereby forming images on the sheets P.

And, the sheets P with the images formed thereon are carried out from a sheet exit part T of the image forming apparatus 1 by transport rolls 114 and are supplied to the post processing apparatus 2 connected to the image forming apparatus 1.

The post processing apparatus 2 is arranged on the downstream side of the sheet exit part T of the image forming apparatus 1 and performs a post process such as a punching process or a binding process on the sheets P with the images formed thereon.

<Post Processing Apparatus 2>

Figure 2:
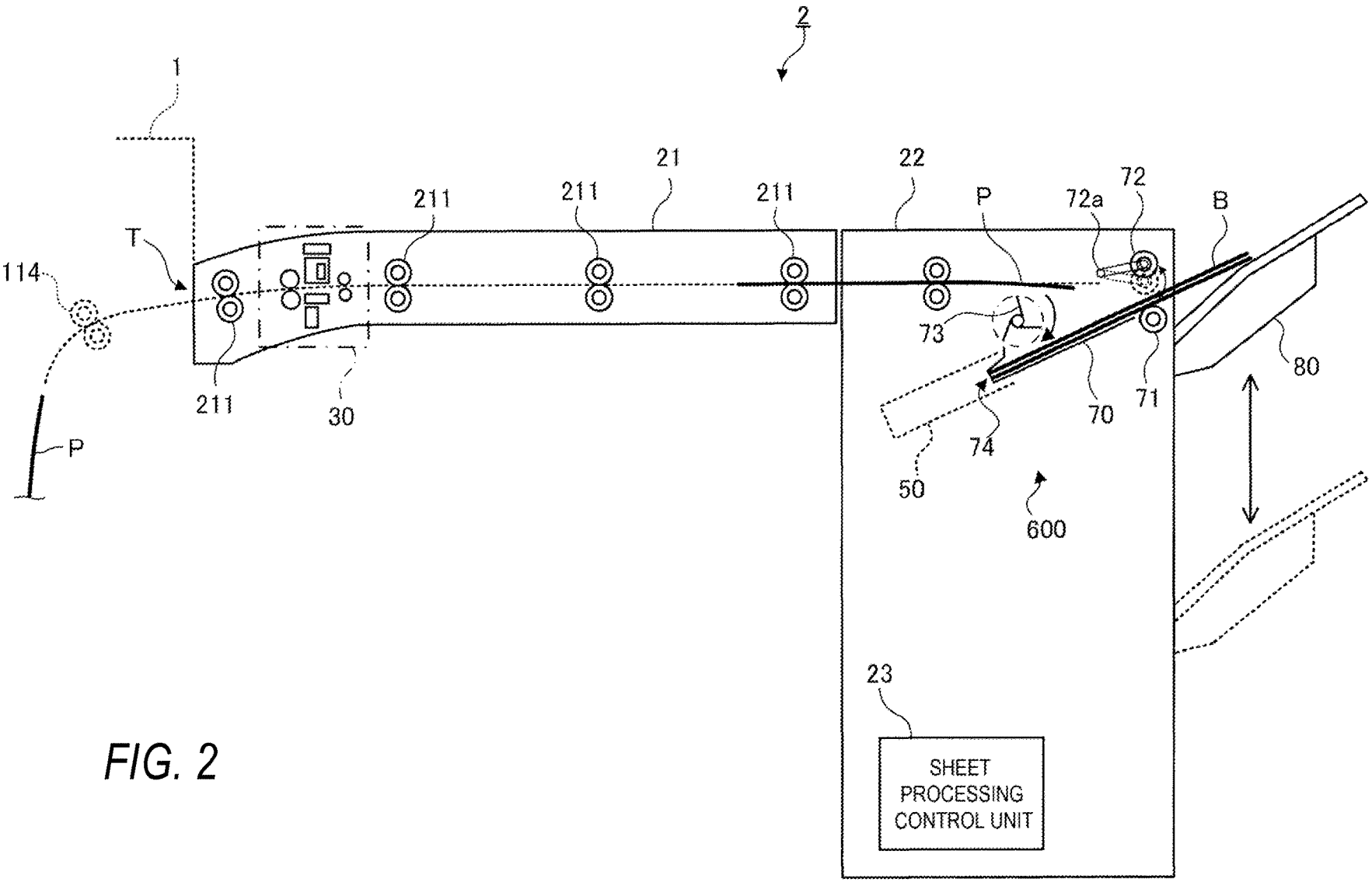
FIG. 2 is a view explaining a configuration of a post processing apparatus to which the present exemplary embodiment is applied.

FIG. 2 is a view explaining a configuration of the post processing apparatus 2.

As shown in FIG. 2, the post processing apparatus 2 functioning as one of image processing apparatuses includes a transport unit 21 connected to the sheet exit part T of the image forming apparatus 1 and a finisher unit 22 for performing a predetermined process on the sheets P transported by the transport unit 21. Various transport paths of the transport unit 21 and finisher unit 22 function as one of transport units for transporting the recording materials with images formed thereon. A transport path of the image forming apparatus 1 after image forming also functions as one of the transport units.

Also, the post processing apparatus 2 includes a sheet processing control unit 23 for controlling the respective mechanism parts of the post processing apparatus 2. The sheet processing control unit 23 is connected to a main body control unit 106 (see FIG. 1) through a signal line (not shown) through which a control signal or the like is mutually transmitted and received.

Also, the post processing apparatus 2 includes a stacker part 80 for stacking thereon the sheets P (sheet bundle B) whose process by the post processing apparatus 2 has been finished.

As shown in FIG. 2, the transport unit 21 of the post processing apparatus 2 includes a punching function part 30 for drilling (punching) holes such as two holes or four holes.

Further, the transport unit 21 includes multiple transport rolls 211 for transporting the sheets P with images formed thereon by the image forming apparatus 1 toward the finisher unit 22.

The finisher unit 22 includes a binding processing device 600 for performing a binding process on a sheet bundle B used as an example of recording material bundles. The binding processing device 600 according to the present exemplary embodiment functions as an example of a binding unit performing a binding processing on the sheet bundle B by tangling together fibers constituting the sheets P without using staples (needles).

The binding processing device 600 includes a sheet collecting part 70 for supporting the sheets P from below and collecting a required number of sheets P to generate the sheet bundle B. The sheet collecting part 70 functions as an example of storage units for storing recording material bundles formed by bundling together recording materials transported by the transport unit. The binding processing device 600 also includes a binding unit 50 for performing a binding process on the sheet bundle B. Here, the sheet collecting part 70 functions as an example of a hold part for holding the sheet bundle B which is a recording material bundle. The sheet collecting part 70 has a mode for storing the sheets P one by one to store the sheet bundle B, and a mode for storing the sheets collectively as the sheet bundle B.

The binding processing device 600 further includes a carry-out roll 71 and a moving roll 72. The carry-out roll 71 rotates clockwise in the drawing and carries the sheet bundle B on the sheet collecting part 70 to the stacker part 80.

The moving roll 72 is provided so as to be movable around a rotation shaft 72*a* and, when collecting the sheets P on the sheet collecting part 70, is situated at a location retreated from the carry-out roll 71. Also, when feeding the generated sheet bundle B to the stacker part 80, the moving roll 72 is pressed against the sheet bundle B on the sheet collecting part 70.

The process to be performed in the post processing apparatus 2 is to be described.

In the present exemplary embodiment, the main body control unit 106 outputs an instruction signal for executing the process on the sheets P to the sheet processing control unit 23. When the sheet processing control unit 23 receives this instruction signal, the post processing apparatus 2 executes the process on the sheets P.

In the process of the post processing apparatus 2, firstly, the sheets P with images formed thereon by the image forming apparatus 1 are supplied to the transport unit 21 of the post processing apparatus 2. In the transport unit 21, after the punch function part 30 punches holes in accordance with the instruction signal from the sheet processing control unit 23, the sheets P are transported toward the finisher unit 22 by the transport rolls 211.

Here, when there is no punching instruction from the sheet processing control unit 23, the sheets P are transported to the finisher unit 22 without execution of the punching process by the punch function part 30.

The sheets P transported to the finisher unit 22 are transported to the sheet collecting part 70 formed in the binding processing device 600. And, the sheets P slide on the sheet collecting part 70 that is given an incline and strike a sheet regulation part 74 formed in the end portion of the sheet collecting part 70.

Thus, the sheets P are caused to stop the movement thereof. In the present exemplary embodiment, as the sheets P strike the sheet regulation part 74, a sheet bundle B in a state where the rear end portions of the sheets P are aligned is generated on the sheet collecting part 70. Here, in the present exemplary embodiment, there is provided a rotation paddle 73 used to move the sheets P toward the sheet regulation part 74.

Figure 3:
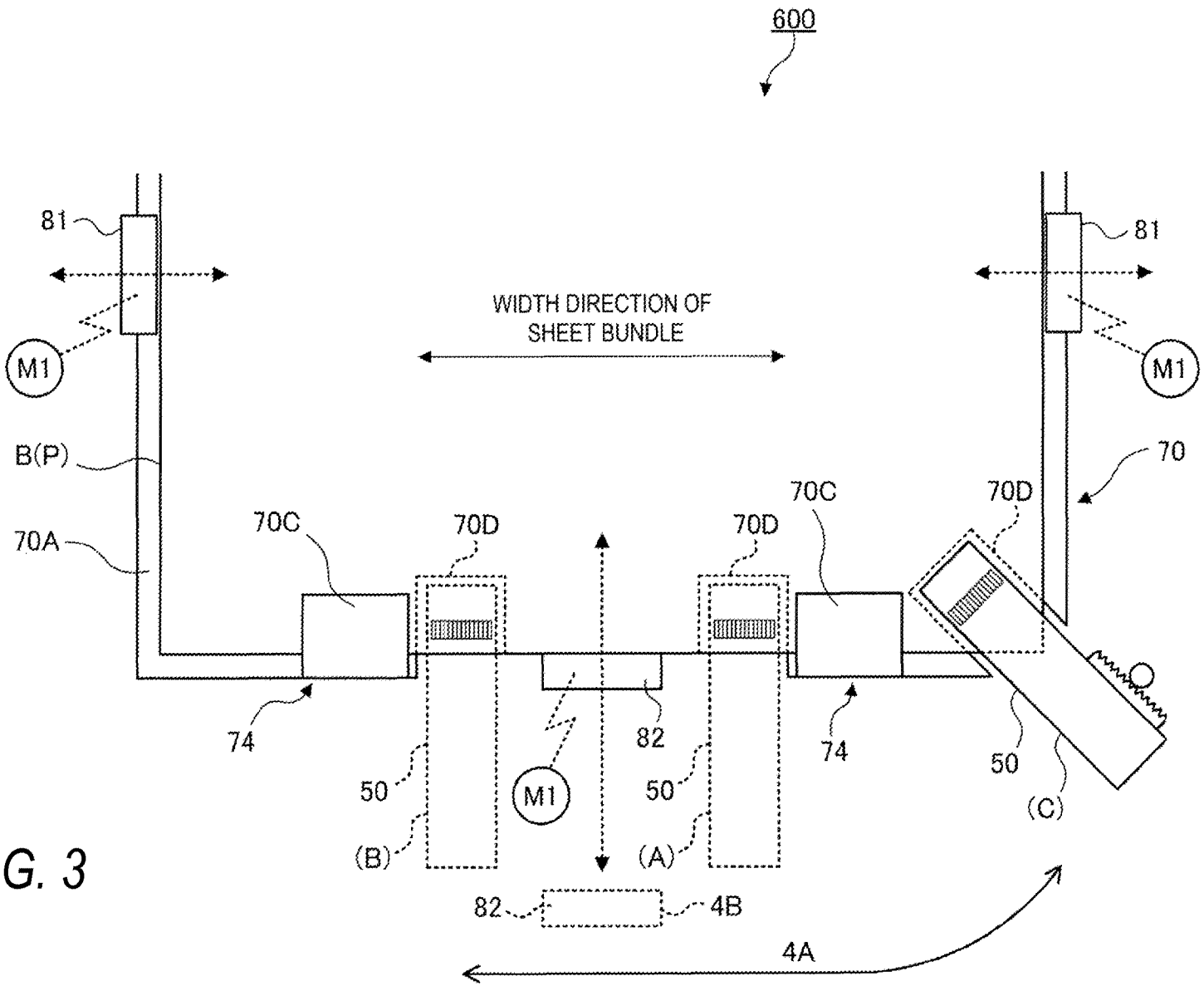
FIG. 3 is a view of a binding processing apparatus to which the present exemplary embodiment is applied.

FIG. 3 is a view of a binding processing apparatus 600 when it is viewed from above.

On the two end portions of the sheet collecting part 70 in the width direction, there are provided first moving members 81. The first moving members 81 are pressed against the lateral sides of the sheets P constituting the sheet bundle B to align the positions of the end portions of the sheets P constituting the sheet bundle B. Also, the first moving members 81 move in the width direction of the sheet bundle B to move the sheet bundle B in the width direction of the sheet bundle B.

Specifically, in the present exemplary embodiment, when the sheets P are collected in the sheet collecting part 70, the first moving members 81 are pressed against the lateral sides of the sheets P, whereby the positions of the lateral sides of the sheets P are aligned.

Also, as described below, when the binding position of the sheet bundle B is changed, the sheet bundle B is pushed by the first moving members 81, whereby the sheet bundle B is moved in the width direction of the sheet bundle B.

Further, the binding processing apparatus 600 according to the present exemplary embodiment includes a second moving member 82.

The second moving member 82 moves in the vertical direction in the drawing to move the sheet bundle B in a direction orthogonal to the width direction of the sheet bundle B.

Moreover, in the present exemplary embodiment, a moving motor M1 for moving the first moving members 81 and second moving member 82 are provided.

As shown by the arrow 4A in FIG. 3, the binding unit 50 is provided so as to be movable in the width direction of the sheets P. And, the binding unit 50 performs a binding process (2-point binding process) on two points (on a position (A) and a position (B)) situated at different locations in the width direction of the sheet bundle B.

Also, the binding unit 50 moves to a position (C) in FIG. 3 and performs a binding process (1-point binding process) on the corner of the sheet bundle B.

Here, the binding unit 50 moves linearly between the position (A) and the position (B), while it moves with rotation of, for example, 45° between the position (A) and the position (C).

The sheet regulation part 74 is formed in an angulated C-like shape. Inside the angulated C-like shape of the sheet regulation part 74, there is formed a regulation part (not shown) extending upward from a bottom plate 70A, and this regulation part comes into contact with the tip ends of the sheets P transported to regulate the movement of the sheets P. The sheet regulation part 74 includes a facing portion 70C formed to face the bottom plate 70A. This facing portion 70C comes into contact with the upper-most sheet P of the sheet bundle B to regulate the movement of the sheets P in the thickness direction of the sheet bundle B.

In the present embodiment, the binding process by the binding unit 50 is performed in locations where the sheet regulation part 74 and second moving member 82 are not provided.

Specifically, as shown in FIG. 3, between the sheet regulation part 74 located on the left side in the drawing and second moving member 82, and between the sheet regulation part 74 located on the right side in the drawing and second moving member 82, the binding process by the binding unit 50 is performed. Further, in the present exemplary embodiment, in a location (the corner portion of the sheet bundle B) adjacent to the sheet regulation part 74 located on the right side in the drawing, the binding processing is performed.

Here, as shown in FIG. 3, three notches 70D are formed on the bottom plate 70A. This prevents interference between the sheet collecting part 70 and the binding unit 50.

Also, in the present exemplary embodiment, as the binding unit 50 moves, the second moving member 82 moves to a position shown by a reference 4B in FIG. 3. This prevents interference between the binding unit 50 and the second moving member 82.

<Structure of Binding Unit 50>

Next, description is given specifically of the binding unit 50 which is a characteristic configuration according to the present exemplary embodiment. The binding unit 50, to which the present exemplary embodiment is applied, functions as a binding apparatus for binding the recording material bundle (sheet bundle B) without using a needle. For example, in the case of a sheet bundle B composed of 2 to 10 sheets, the sheet bundle B is pressed using upper and lower teeth to thereby bind the sheet bundle B. In this case, binding a sheet bundle B composed of a large number of sheets requires a very large pressing force. The binding unit 50 according to the present exemplary embodiment realizes a pressing force of, for example, 10 thousand newtons due to the below-described configuration. Also, even in the binding apparatus capable of providing such large pressing force, shape miniaturization may be realized; and thus, an existing stapler apparatus using a needle may be replaced with the present binding apparatus at the same location. Also, in the existing stapler apparatus using a needle, it is possible to provide a large opening in a standby state; but, in a binding apparatus using no needle, generally, it is difficult to provide a large opening in a standby state. However, in the binding unit 50 according to the present exemplary embodiment, a sufficient opening is provided in a standby state using a mechanism described below.

Figure 4:
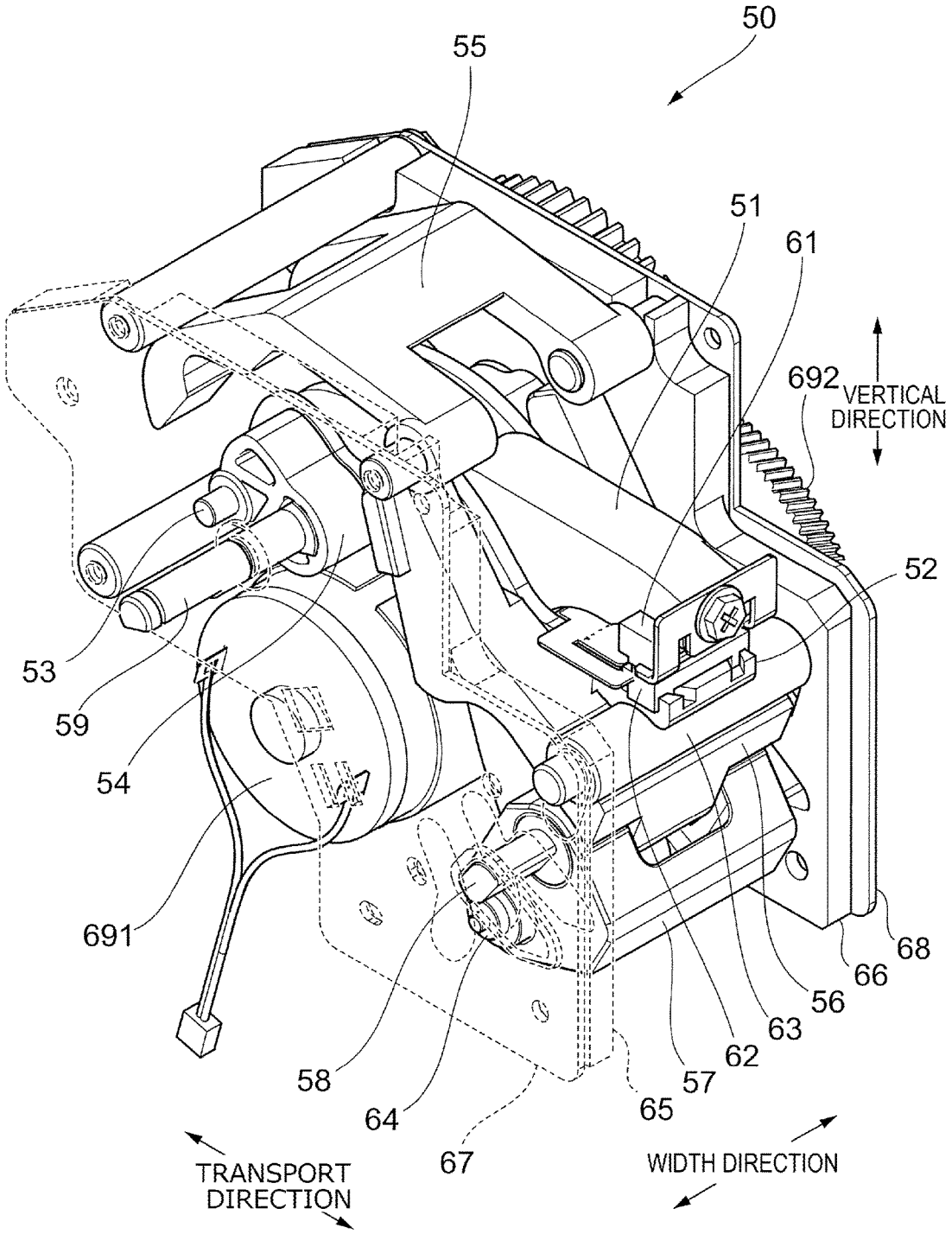
FIG. 4 is a perspective view of a binding unit to which the present exemplary embodiment is applied.
Figure 5:
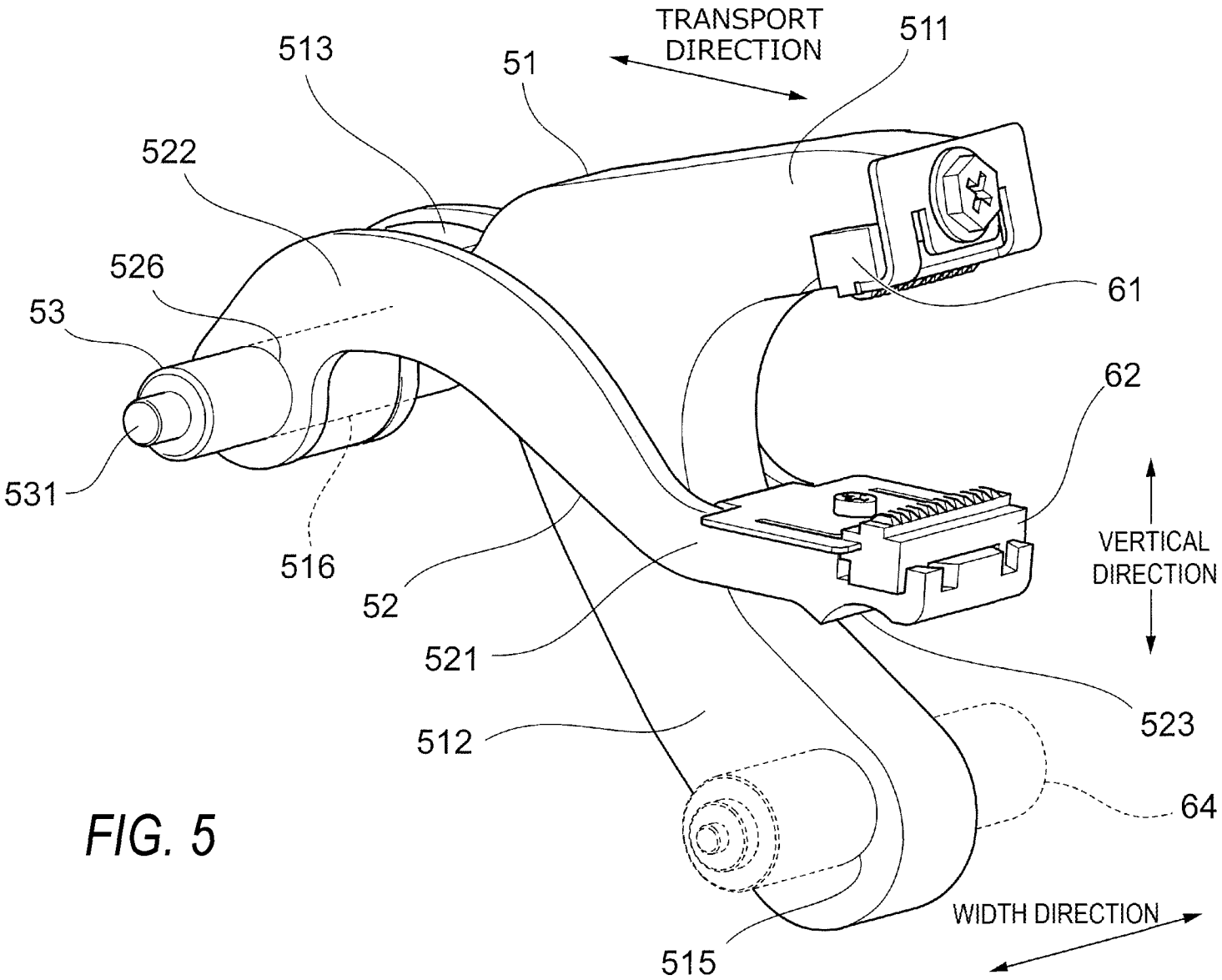
FIG. 5 is a view explaining a portion where the binding unit according to the present exemplary embodiment comes into contact with a sheet bundle.
Figure 6:
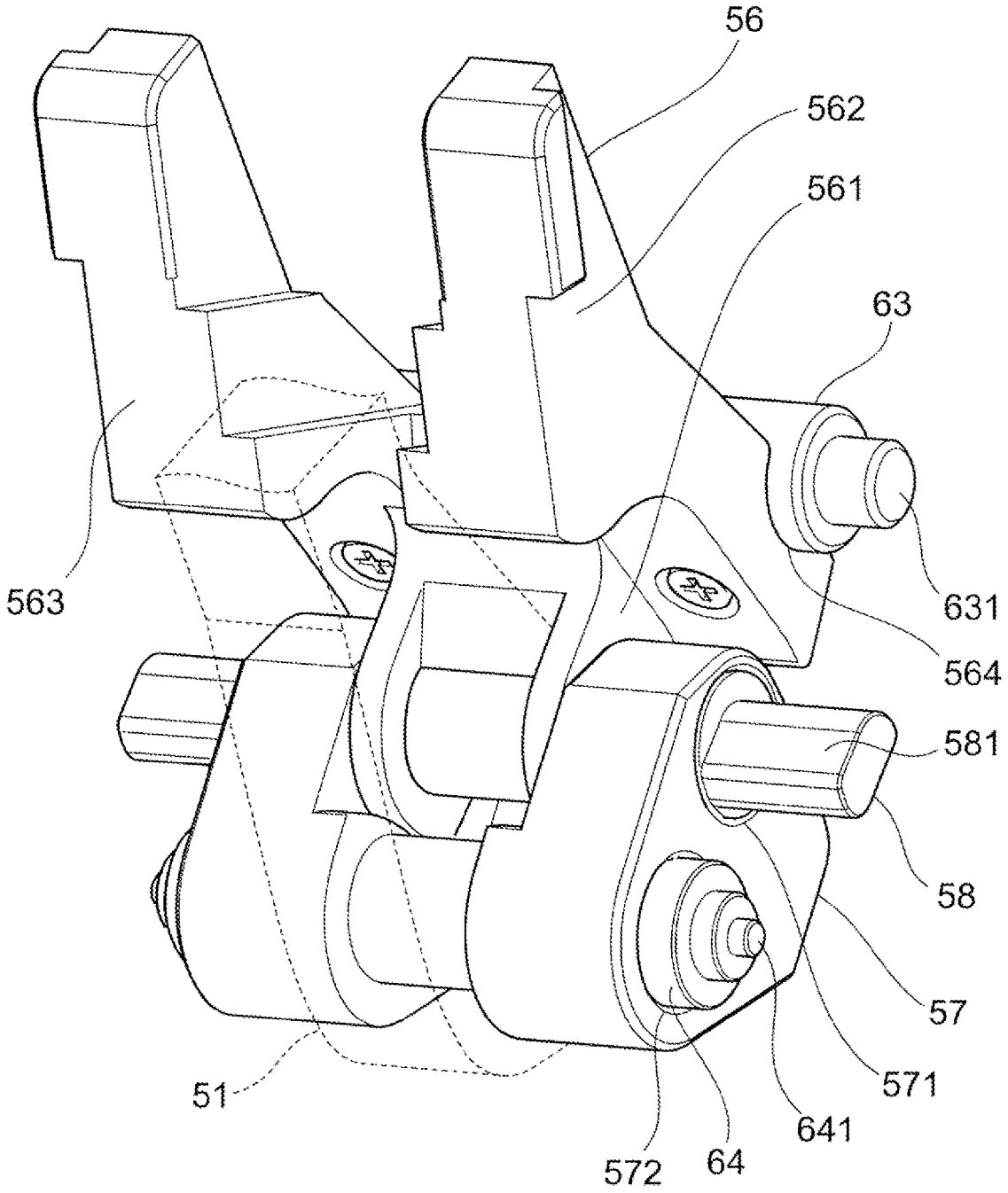
FIG. 6 is a view explaining a pressing structure of the binding unit according to the present exemplary embodiment.
Figure 7:
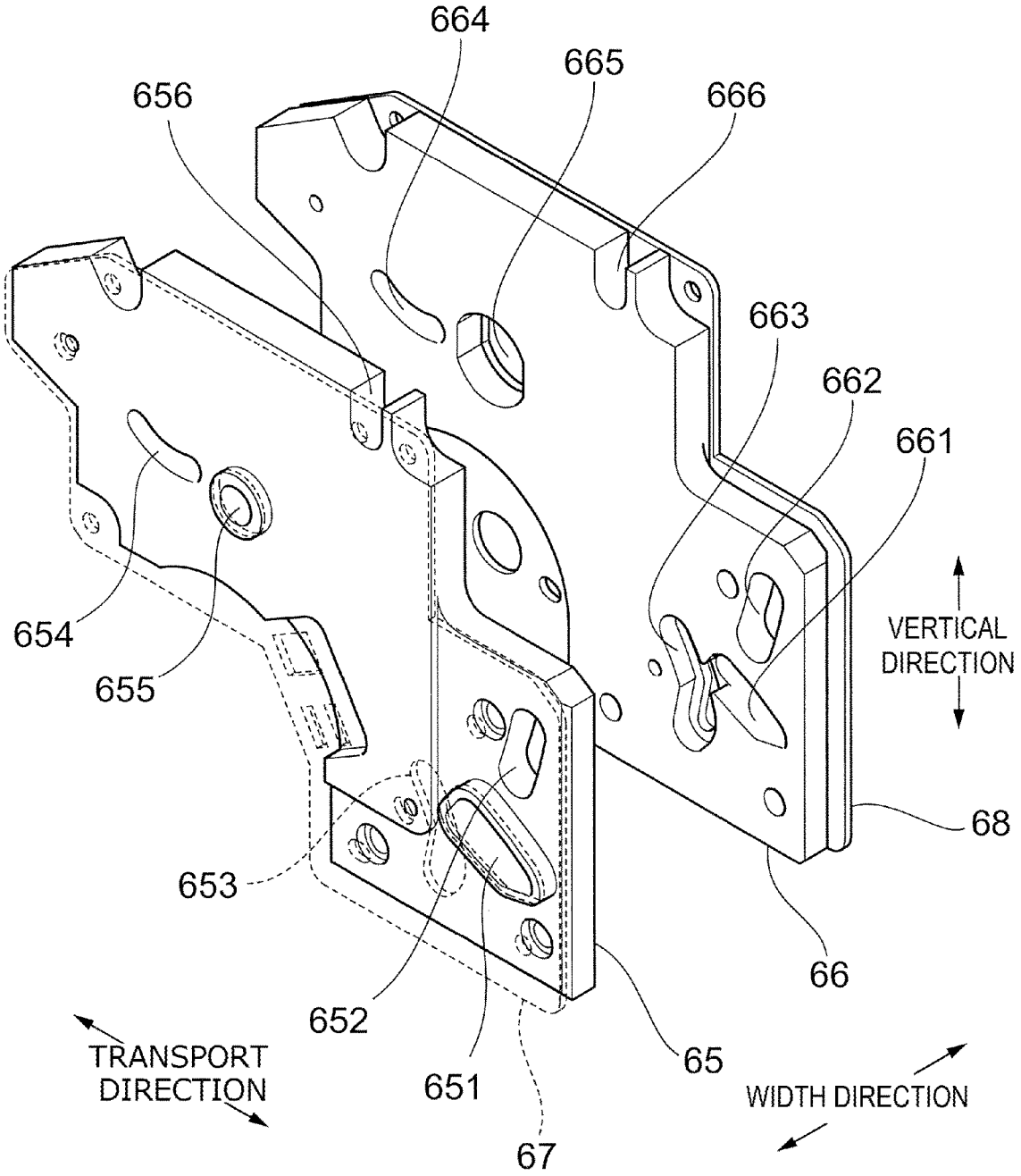
FIG. 7 is a view explaining a guide part for guiding operations of the respective structures of the binding unit according to the present exemplary embodiment.
Figure 8:
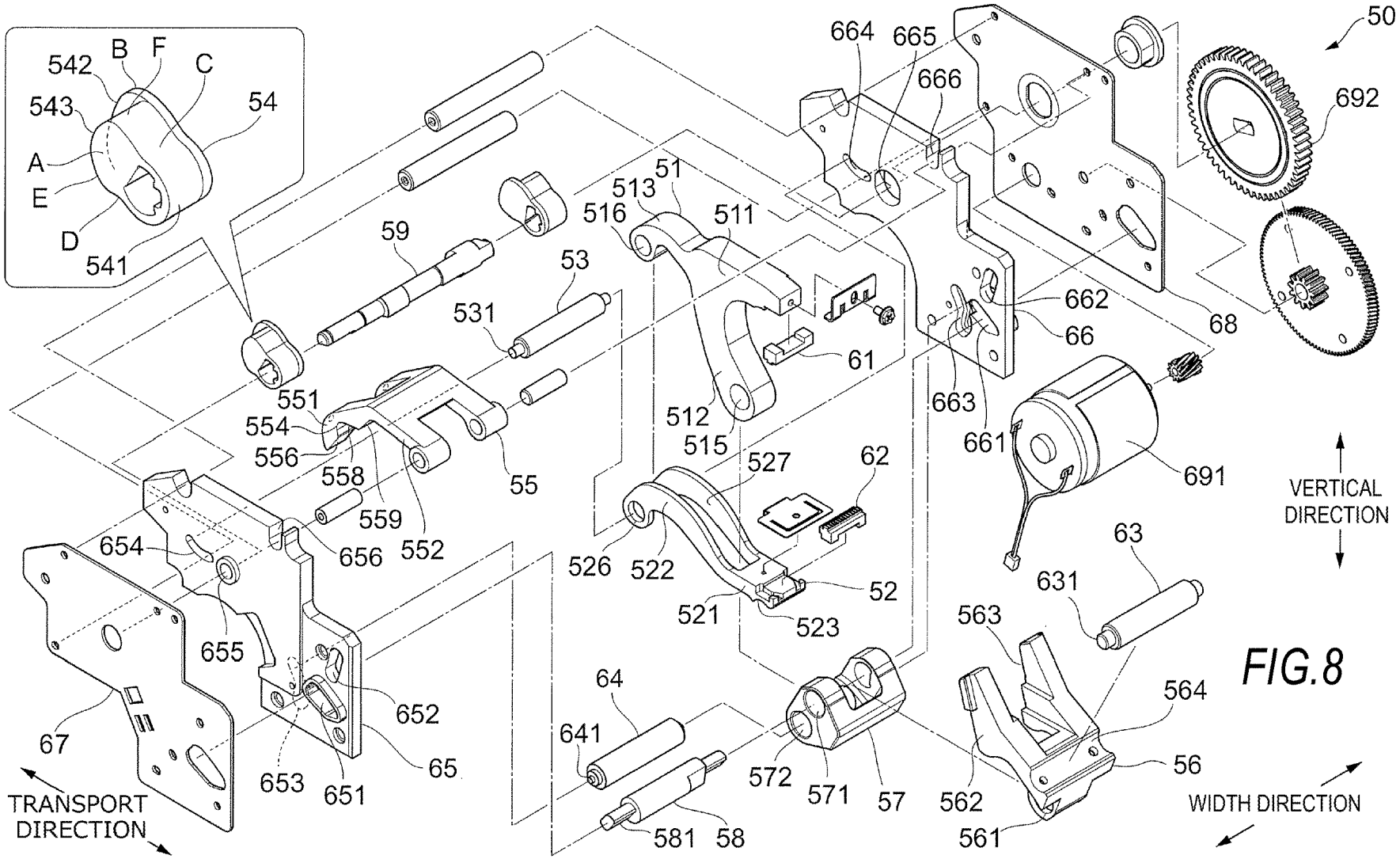
FIG. 8 is an exploded view of the binding unit according to the present exemplary embodiment.

Firstly, the structure of the binding unit 50 is explained with reference to FIGS. 4 to 8. FIG. 4 is a perspective view of the binding unit 50 according to the present exemplary embodiment. FIG. 5 is a view explaining a portion where the binding unit 50 comes into contact with a sheet bundle. FIG. 6 is a view explaining a pressing structure of the binding unit 50. FIG. 7 is a view explaining a guide part for guiding the operations of the respective structures of the binding unit 50. FIG. 8 is an exploded view of the binding unit 50.

Here, in the following description, the width direction of the sheet bundle B shown in FIG. 3 is simply referred to as the "width direction", the thickness direction of the sheet bundle B is simply referred to as the "vertical direction", and the transport direction of the sheet bundle B to be transported is simply referred to as the "transport direction".

The binding unit 50 of the present exemplary embodiment, as shown in FIGS. 4, 5 and 8, includes: an upper arm 51 which has an upper tooth 61 in one end thereof and is used to press the sheet bundle B in the thickness direction to thereby deform it; and, a lower arm 52 which has, in one end thereof, a lower tooth 62 facing the upper tooth 61 and is used to press the sheet bundle B in the thickness direction to thereby deform it. The binding unit 50 also includes a shaft arm 53 for connecting together the upper arm 51 and lower arm 52. The upper tooth 61 of the upper arm 51 and the lower tooth 62 of the lower arm 52 move through the shaft arm 53 serving as the same fulcrum to thereby change their mutual facing relationship, and also move while having such a component in the transport direction (moving direction) of the sheets P or sheet bundle B as allows the shaft arm 53 serving as the fulcrum to enter the pressing areas of the upper and lower arms, whereby the upper and lower arms are allowed to retreat and project.

The upper arm 51 functioning as an arm member includes one end part 511 having the upper tooth 61, and the other end part 512 bending and extending integrally from the one end part 511. The upper arm 51 also includes a support part 513 for supporting the upper arm 51 in the vicinity of a point of bend between the bending one end part 511 and the other end part 512. The one end part 511 of the upper arm 51 functions as a first pressing part for pressing the sheet bundle B.

The other end part 512 includes a link connecting hole 515 serving as a start point at which the lower arm 52 is pushed out toward the upper arm 51 by a pushout link structure (discussed later). A lower shaft lever 64 (discussed later) is inserted through the link connecting hole 515. The link connecting hole 515 and lower shaft lever 64 serve as a start point of the movement of the pushout link structure. Also, the support part 513 has a rotation center hole 516 serving as the center of rotation of the upper arm 51. The one end part 511 having the upper tooth 61 functions as a first pressing part.

The upper arm 51 has a substantially uniform thickness in the width direction and is curved only in one portion in a V-like shape (or, in a U-like or an L-like shape) in the transport direction. More specifically, an imaginary line connecting the one end part 511 having the upper tooth 61 functioning as the first pressing part and the rotation center hole 516 functioning as the rotation axis and an imaginary line connecting the link connecting hole 515 formed in the other end part 512 and serving as the start point and rotation center hole 516 intersect. Also, the upper arm 51 including the one end part 511 and the other end part 512 is formed of an integral member. In the present exemplary embodiment, as the material of the upper arm 51 formed of an integral member, there is used chrome molybdenum steel. This chrome molybdenum steel is higher in strength and hardness than ordinary carbon steel, and may also have moderate "flexibility".

The lower arm 52 functioning as an arm structure includes one end part 521 having the lower tooth 62 functioning as a second pressing part, and the other end part 522 extending substantially in one direction from the one end part 521. The one end part 521 of the lower arm 52 functions as a second pressing part. On the side of the one end part 521 having the lower tooth 62, there is formed a recessed part 523 facing a point of action of a pushout link structure (discussed later) for pushing out the lower arm 52 toward the upper arm 51. At the point of action of the pushout link structure, there is provided an upper shaft lever 63 (discussed later). The recessed part 523 provides a portion having a curved shape whose diameter is equal to or larger than that of the upper shaft lever 63 and is formed substantially vertically downward of a location having the lower tooth 62 in one end part 521 of the lower arm 52. The recessed part 523 and upper shaft lever 63 serve as a point of action of the movement of the pushout link structure.

In the other end part 522 of the lower arm 52 having an arm structure, there is formed a rotation center hole 526 serving as the center of rotation of the lower arm 52, while the rotation center hole 526, coaxially with the rotation center hole 516 serving as the center of rotation of the upper arm 51, holds the lower arm 52 rotatably.

That is, the rotation center hole 516 of the upper arm 51 and the rotation center hole 526 of the lower arm 52 are coaxially held by the shaft arm 53. And, the shaft arm 53 includes small diameter parts 531 in both ends thereof, while the small diameter parts 531 are engaged into long-hole shaped notches (arm guides 654 and 664, discussed later) formed in guide members (a left side guide 65 and a right side guide 66, discussed later) to be provided in the two end portions of the shaft arm 53 in the width direction.

Thus, the shaft arm 53 is configured to be movable while having a moving component (discussed later) in the transport direction and holds the upper arm 51 and lower arm 52 so as to be movable in the transport direction (in a direction where the sheet bundle B enters and exits). Also, a notch 527 which allows the movement of the upper arm 51 in the vertical direction is formed at the lower arm 52.

Next, with reference to FIGS. 4, 6 and 8, description is given of the pushout link structure whose operation starts from the link connecting hole 515 formed in the upper arm 51. This pushout structure functions as an example of a pushout part (a pushout structure).

The pushout link structure in the binding unit 50 moves the lower arm 52 in the vertical direction by the expansion and contraction movements of the lever 56 and link 57. A spindle 58 is provided in the connecting portion (joint) between the lever 56 and link 57.

The lever 56 includes a connecting part 561 to be connected to the spindle 58 and a main body part 562 extending from the connecting part 561. The main body part 562 includes, in one end, contact surfaces 563 to come into contact with cams 54 (discussed later) and, in the other end, a pushup part 564 for pushing up the lower arm 52. On the pushup part 564, there is mounted an upper shaft lever 63 which comes into contact with the lower arm 52. The upper shaft lever 63 has a cylindrical shape and includes on both ends thereof small diameter parts 631 whose diameters are small, while the small diameter parts 631 are engaged into notches (pushup guides 652 and 662, discussed later) formed in guide members (a left guide 65 and a right guide 66, discussed later). The cylindrical upper shaft lever 63 is in contact with the curved-shaped recessed part 523 of the lower arm 52. Thus, such contact between the cylindrical shape and curved shape allows the contact location to have some degrees of freedom.

The link 57 includes, in one end thereof, a connecting part 571 to be connected to the spindle 58 and, in the other end, a start point connecting part 572 to be connected to the link connecting hole 515 of the upper arm 51 by a lower shaft lever 64 (discussed later). This start point connecting part 572 functions as a start point of the pushout link structure serving as the pushout part. Also, as described above, the upper shaft lever 63 functions as a point of action of the pushout link structure serving as the pushout part. The pushout link structure serving as the pushout part changes the distance between a start portion serving as a start point of the pushout movement, thereby pushing out one end part 521 of the lower arm 52 toward one end part 511 of the upper arm 51.

The spindle 58 has a cylindrical shape and includes plate-shaped parts 581 respectively formed in both ends thereof each having a plane portion, while the plate-shaped parts 581 are respectively engaged into notches (spindle guides 651 and 661, discussed later) formed in guide members (left and right guides 65 and 66, discussed later).

The start point connecting part 572 has a lower shaft lever 64 serving as a start point of the pushout link structure, and this lower shaft lever 64 is inserted into a link-connecting hole 515 to be formed in the upper arm 51. Thus, the upper arm 51 and pushout link structure are connected to each other. The cylindrical lower shaft lever 64 includes small diameter parts 641 in the both ends thereof, while the small diameter parts 641 are engaged into notches (lower guides 653 and 663, discussed later) formed in guide members (left and right guides 65 and 66, discussed later).

Next, description is given of a housing structure of the binding unit 50 with reference to FIGS. 4, 7 and 8. This housing structure includes left and right guides 65 and 66 for guiding the movements of the respective structures of the binding unit 50, and left and right housings 67 and 68 respectively arranged outside their associated left and right guides 65 and 66 for fixing them.

The left and right guides 65 and 66 respectively include spindle guides 651, 661 for guiding the movements of the plate-shaped parts 581 of the spindle 58, and pushup guides 652, 662 for guiding the movements of the small diameter parts 631 of the upper shaft lever 63. Also, the left and right guides 65 and 66 respectively include lower guides 653, 663 for guiding the movements of the small diameter parts 641 of the lower shaft lever 64, and arm guides 654, 664 for guiding the movements of the small diameter parts 531 of the shaft arm 53. Further, the left and right guides 65 and 66 respectively include cam rotation shaft holes 655, 665 for supporting a rotation shaft 59 of a cam 54 (discussed later) rotatably, and stopper rotation shaft holes 656, 666 for supporting a rotation part of a stopper 55 (discussed later) rotatably.

The spindle guides 651, 661, pushup guides 652, 662, lower guides 653, 663 and arm guides 654, 664 respectively have long-hole shapes, and allow movements in a direction along the long-hole shapes. The respective long holes have transport direction components and/or vertical direction components. Specifically, the spindle guides 651, 661 and arm guides 654, 664 allow the movements of the transport direction components particularly; and, the pushup guides 652, 662 and lower guides 653, 663 allow the movements of the vertical direction components particularly.

Next, description is given of a drive structure of the binding unit 50 with reference to FIGS. 4 and 8. The binding unit 50 includes a motor 691 serving as a drive source and gears 692 for transmitting drive. The binding unit 50 also includes a cam 54 for producing an uneven movement and a rotation shaft 59 for transmitting a drive force obtained from the motor 691 through the gears 692 to the cam 54. In the present exemplary embodiment, the shaft arm 53, contact surfaces 563 of the lever 56 and a stopper 55 (discussed later) are brought into contact with the cam 54 to perform predetermined movements according to the shape of the cam 54.

The cam 54 is composed of two eccentric cams (a first cam and a second cam) whose outside diameter shapes are different in the width direction (in the thickness direction of the cam 54) on the same shaft. The first and second cams include cam valley parts 541 having the same eccentricity, and a first cam crest part 542 and a second cam crest part 543 whose eccentric amounts are different from each other. The cam valley parts 541 are in contact with the shaft arm 53, the first cam crest parts 542 are in contact with the shaft arm 53 and stopper 55, and the second crest parts 543 are in contact with the contact surfaces 563 of the lever 56.

The stopper 55 presses the shaft arm 53 in the direction of the cams 54. Also, the stopper 55 has a function which, when the contact surfaces 563 of the lever 56 come into contact with the cams 54, fixes the position of the shaft arm 53. The stopper 55 includes a tip end part 551 to come into contact with the shaft arm 53, and a rear end part 552 for supporting the stopper 55 rotatably. The tip end part 551 includes, in the lower surface thereof in the vertical direction, a recessed portion 554, a retreat slide surface 556, a lock slide surface 558 and a lift-up slide surface 559, and is pressed from the upper surface thereof by a spring (not shown). The recessed portion 554 has a curved shape and the inside diameter thereof is equal to or larger than the outside diameter of the shaft arm 53.

<Operation of Binding Unit 50>

Next, description is given specifically of the operation of the binding unit 50 according to the present exemplary embodiment.

The binding unit 50, under the control of the sheet processing control unit 23, is operated by the movement of the cam 54 which has received the drive force of the motor 691 through the gears 692. In the present exemplary embodiment, the rotation of a single cam, that is, the cam 54 enables the binding unit 50 to move. As described later, the cam 54 swings at least one of the first and second pressing parts in a direction to press the sheet bundle B. The cam 54 functions as a moving mechanism which moves the swinging pressing parts to the pressing area of the sheet bundle B, that is, moves the first and second pressing parts to the pressing area of the sheet bundle B in a direction where the sheets P or sheet bundle B enter(or enters) and exit (or exits).

Here, the following description is given based on a point of inflection of the cam 54. As shown in FIG. 8 and FIGS. 9A-9F, let A, B be the points of inflection of the first cam crest part 542, C, D be the points of inflection of the cam valley part 541, and E, F be the points of inflection of the second cam part 543. And, the description is given assuming that a surface belonging to the first cam crest part 542 is an "A-B surface", a surface belonging to the cam valley part 541 is a "C-D surface", and a surface belonging to the second cam crest part 543 is an "E-F surface".

Figure 9A:
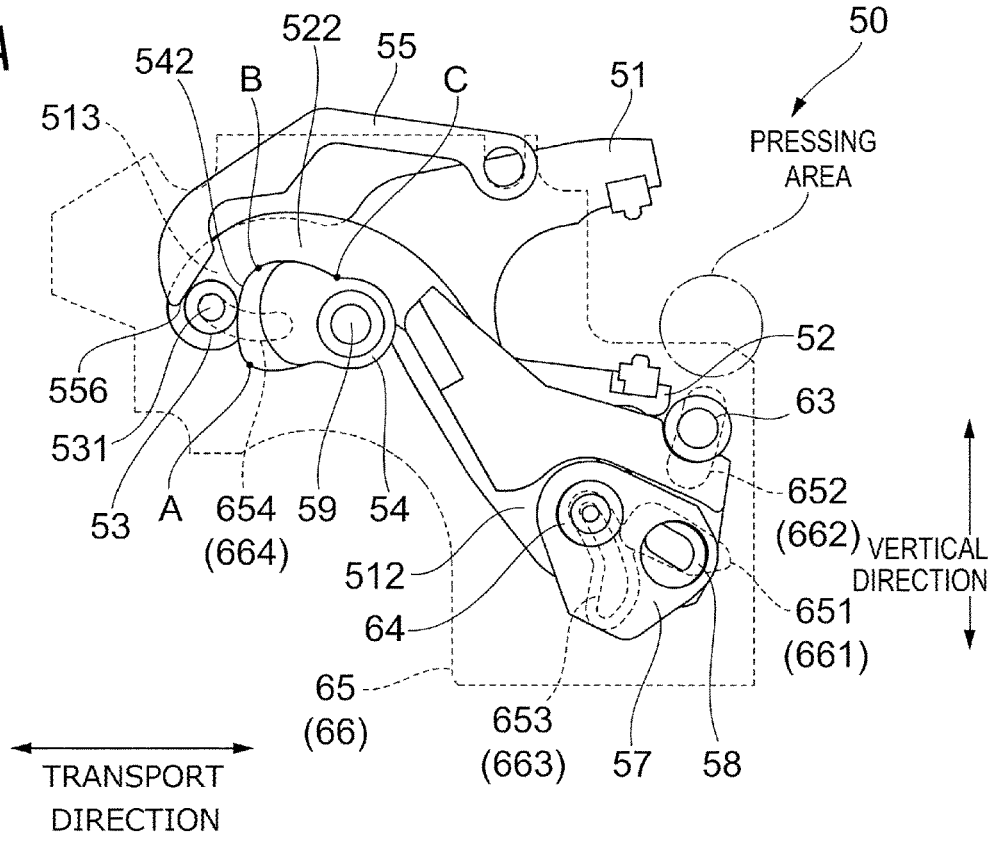
FIG. 9A is a view explaining a retreat state of the binding unit according to the present exemplary embodiment.
Figure 9B:
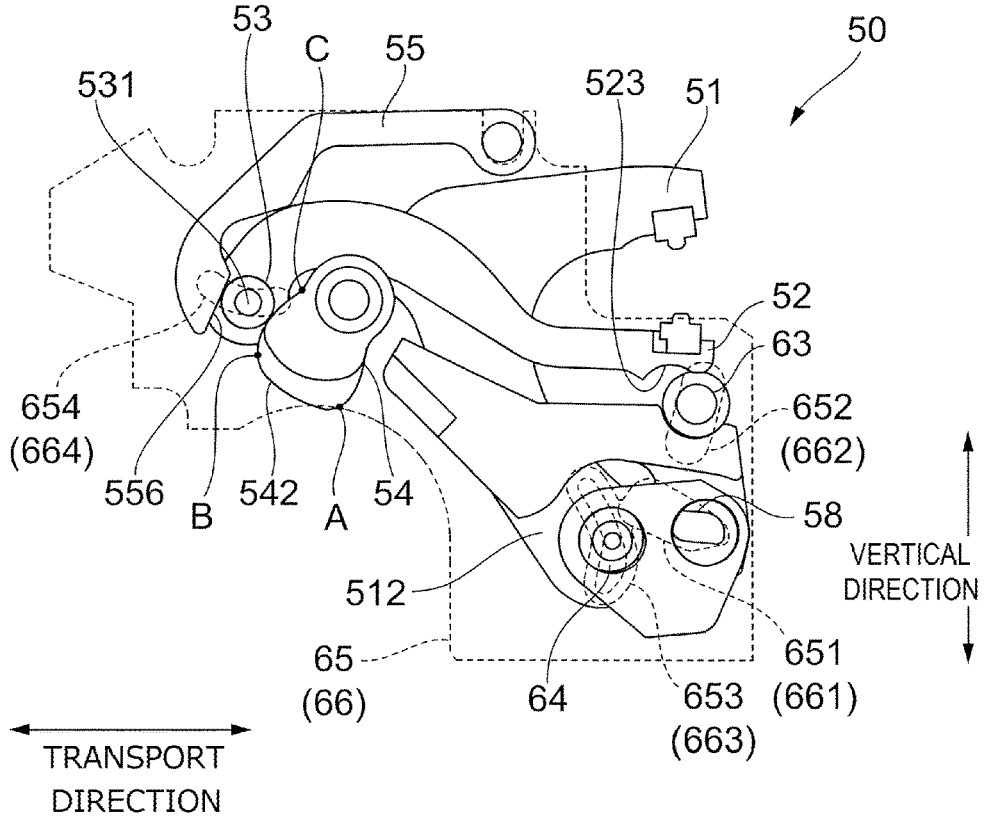
FIG. 9B is a view explaining the retreat state of the binding unit according to the present exemplary embodiment.

FIGS. 9A and 9B are views explaining a retreat state of the binding unit 50. FIG. 9A shows a state where the binding unit 50 retreats most, and FIG. 9B shows a transition stage where the binding unit 50 protrudes. The binding unit 50 protrudes to the pressing area where a binding operation is performed. Here, when the sheets P enter a pressing area formed in the sheet collecting part 70, the binding unit 50 is in the retreat state shown in FIG. 9A, that is, it retreats to the downstream side in the transport direction where the sheets P enter the pressing area.

Figure 9C:
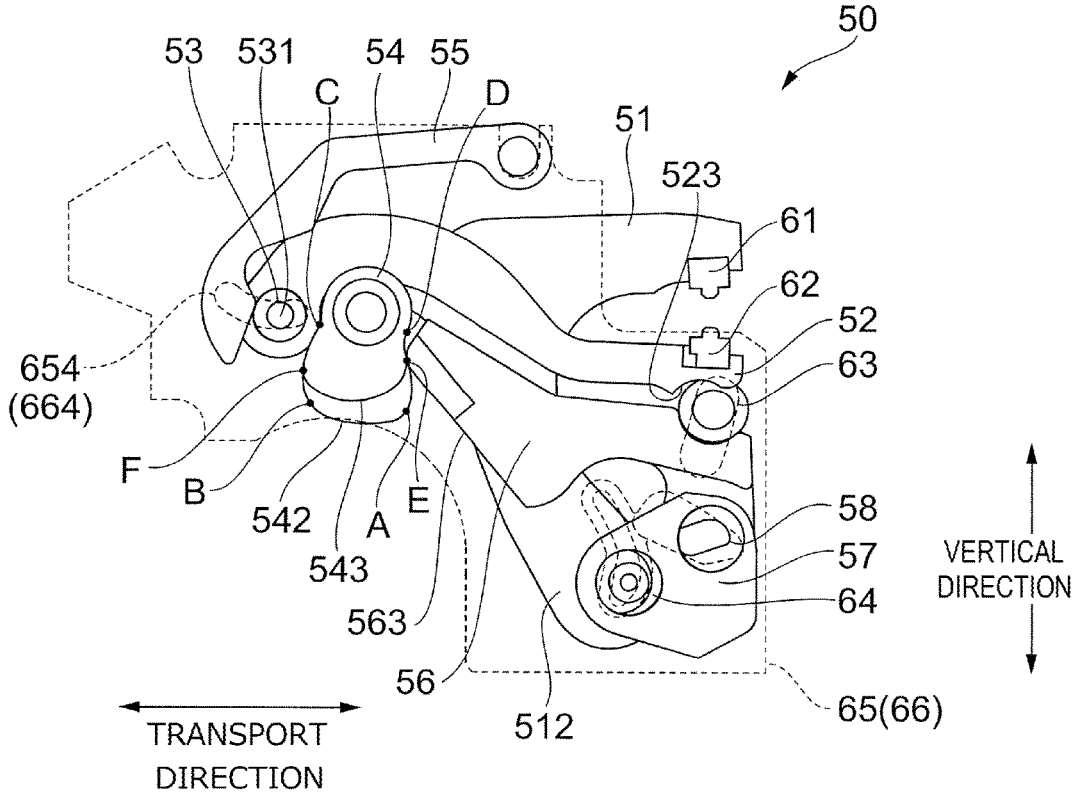
FIG. 9C is a view explaining a binding operation of the binding unit according to the present exemplary embodiment.
Figure 9D:
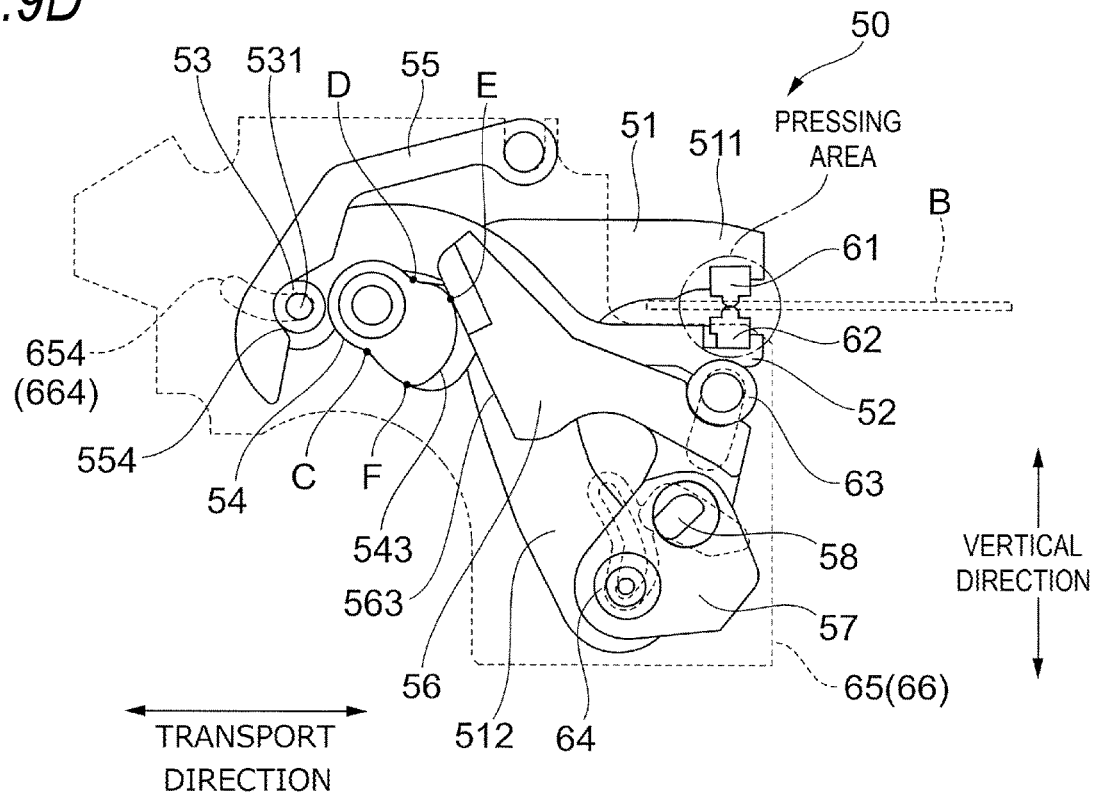
FIG. 9D is a view explaining the binding operation of the binding unit according to the present exemplary embodiment.

Also, FIGS. 9C and 9D are views explaining the binding operation of the binding unit 50. FIG. 9C shows a state where the upper and lower teeth 61 and 62 of the binding unit 50 approach each other, and FIG. 9D shows a start state where the binding unit 50 starts a binding operation in the pressing area.

Figure 9E:
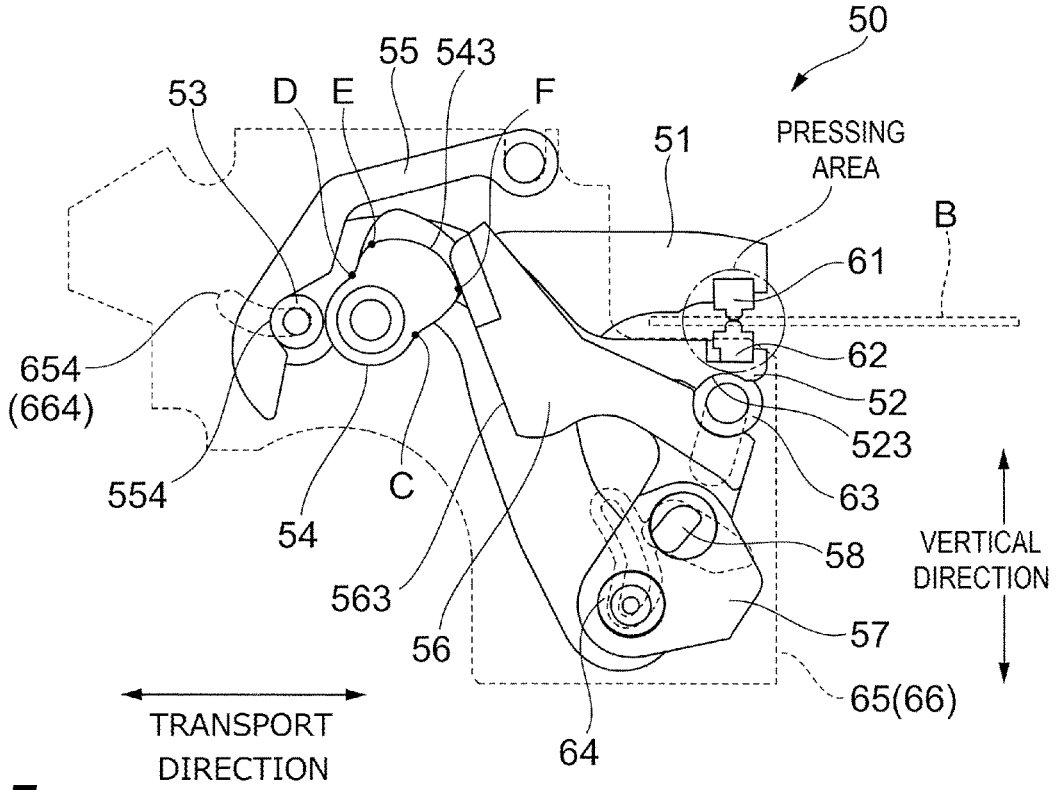
FIG. 9E is a view explaining the binding operation of the binding unit according to the present exemplary embodiment.
Figure 9F:
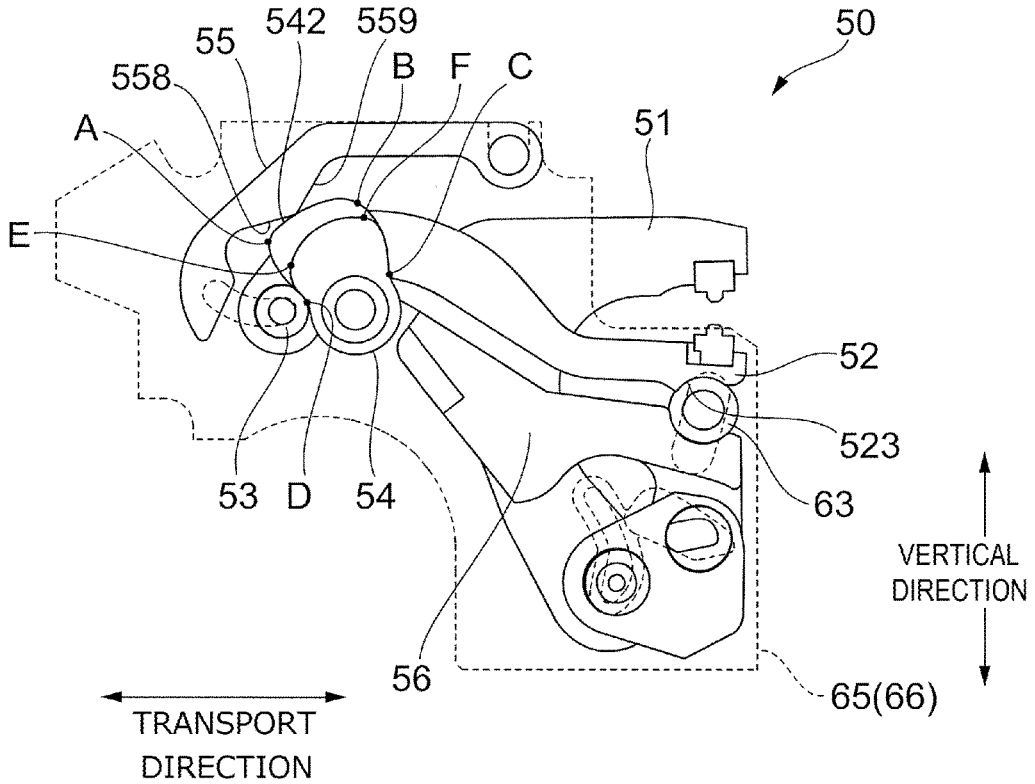
FIG. 9F is a view explaining a state where a stopper of the binding unit according to the present exemplary embodiment is lifted.

Also, FIGS. 9E and 9F are views explaining the binding operation of the binding unit 50 and a state where the stopper 55 is lifted up. FIG. 9E shows the maximum state of a binding force in the binding unit 50, and FIG. 9F shows a state where the stopper 55 is lifted up and the recessed portion 523 of the lower arm 52 is thereby released from the upper shaft lever 63.

The cam 54 rotates counterclockwise as the rotation shaft 59 rotates. In FIG. 9A, the A-B surface of the cam 54 is in contact with the shaft arm 53. In this case, the small diameter parts 531 of the shaft arm 53 are pressed against the one-side ends of the arm guides 654, 664 of the left and right guides 65, 66 by the A-B surface of the cam 54. The present one-side ends are situated on the most-downstream sides (the left-most sides in FIG. 9A) of the arm guides 654, 664 in the transport direction, and the shaft arm 53 is situated on the most-downstream sides in the transport direction. The upper arm 51 and lower arm 52 are supported on the shaft arm 53 by the support part 513 and the other end part 522, while the upper arm 51 and lower arm 52 are also in the retreat state at the most downstream position.

At that time, in the other end part 512 of the upper arm 51, the lower shaft lever 64 is pressed against the one-side ends of the lower guides 653, 663 of the left and right guides 65, 66. The present one-side ends are situated on the most downstream side in the transport direction of the lower guides 653, 663, and also are situated at the upper-most end in the vertical direction. As a result, the other end of the link 57 including the lower shaft lever 64 is also situated on the most downstream side in the transport direction and is situated at the upper-most end in the vertical direction. At that time, one end of the link 57 including the spindle 58 is situated at the lower-most end in the vertical direction, and the upper shaft lever 63 mounted on the lever 56 is situated downward in the vertical direction. Here, at that time, the upper shaft lever 63 is not in contact with the recessed portion 523 of the lower arm 52. Also, the retreat slide surface 556 of the stopper 55 is pressed against the shaft arm 53 by a spring (not shown), and the shaft arm 53 is in close contact with the cam 54.

After then, due to rotation of the cam 54, as shown in 9B, the contact position between the cam 54 and shaft arm 53 is changed from the A-B surface of the cam 54 to the B-C surface. As shown in FIG. 9B, the shaft arm 53 moves to the upstream side in the transport direction along the arm guides 654, 664. Due to the movement of the shaft arm 53, the upper arm 51 and lower arm 52 are moved in the upstream direction (in FIG. 9B, to the right side). Here, with the movement of the lower arm 52, the distance between the upper shaft lever 63 and the recessed portion 523 of the lower arm 52 lessens.

Due to rotation of the cam 54, the shaft arm 53 is separated from the cam 54 and the lever 56 is brought into contact with the cam 54, whereby the state shifts from the state shown in FIG. 9B to the state shown in 9C. In this case, the point of action of the cam 54 shifts from the first cam crest part 542 having the A-B surface to the second cam crest part 543 having the E-F surface.

As shown in FIG. 9C, when the D-E surface of the cam 54 comes into contact with the tip end of the contact surface 563 of the lever 56, the lever 56 is driven by the cam 54 to start to swing upward in the vertical direction.

In this state, since the C-D surface of the cam 54 is not in contact with the shaft arm 53, the shaft arm 53 is released from the constraint of the cam 54. Since a force going downstream in the transport direction is always applied to the shaft arm 53 through the stopper 55 by a spring (not shown), the shaft arm 53 moves upstream in the transport direction along the arm guides 654, 664. Due to this movement of the shaft arm 53, the upper arm 51 and lower arm 52 move upstream (in FIG. 9C, to the right side).

With the upstream movement of the lower arm 52, the distance between the upper shaft lever 63 and the recessed portion 523 of the lower arm 52 further lessens, whereby they are both situated substantially one above the other. After then, the recessed portion 523 of the lower arm 52 covers the upper shaft lever 63, and the lower arm 52 receives the upward movement of the upper shaft lever 63 in the recessed portion 523. And, with the upward movement of the upper shaft 63, the lower tooth 62 mounted on the lower arm 52 is pushed out toward the upper tooth 61.

After then, when the cam 54 rotates further, as shown in FIG. 9D, the contact surface 563 of the lever 56 starts to come into contact with the E-F surface of the cam 54. And, as the lever 56 is pressed against the E-F surface of the cam 54, the link 57 is pushed via the spindle 58, and the other end part 512 of the upper arm 51 is pushed downward in the vertical direction via the lower shaft lever 64. As a result, the one end part 511 of the upper arm 51 is moved, and the upper tooth 61 mounted on the one end part 511 is pushed out toward the lower tooth 62. FIG. 9D shows a state where a pressing action on the sheet bundle B by the upper and lower teeth 61 and 62 is started.

Here, the shaft arm 53 receives a force from the stopper 55 and is thereby pressed against the most upstream sides of the arm guides 654, 664 in the transport direction. And, the upper arm 51 and lower arm 52 mounted on the shaft arm 53 are protruded to the most upstream side (in FIG. 9D, toward the right side) in the transport direction.

After then, the cam 54 rotates still further, and the contact surface 563 of the lever 56 is pressed further by the E-F surface of the cam 54. As a result, the link 57 is pushed more strongly through the spindle 58, and the other end part 512 of the upper arm 51 is pushed more strongly downward in the vertical direction via the lower shaft lever 64. And, as shown in FIG. 9E, when the contact surface 563 of the lever 56 comes into contact with the F point of the cam 54, a pressing force on the sheet bundle B by the upper and lower teeth 61 and 62 becomes greatest. Due to shift of the state from FIG. 9D to FIG. 9E, between one end and the other end of the upper arm 51 being curved in a V shape (or in a U shape), the lever 56 and link 57 extend like a jack structure, and the strong pressing force on the sheet bundle B applied by the upper and lower teeth 61 and 62 is received thanks to the "flexibility" of the material of the upper arm 51. In this manner, a pressing force of, for example, approximately 1 ton of pressing force is applied onto the sheet bundle B.

After the binding operation on the sheet bundle B is finished in this manner, when the cam 54 rotates still further, the F-C surface of the cam 54 comes into contact with the contact surface 563 of the lever 56, whereby the pressing by the upper and lower teeth 61 and 62 is removed gradually. After then, when the cam 54 continues to rotate, as shown in FIG. 9F, the stopper 55 is lifted up by the A-B surface of the cam 54, thereby allowing the downstream movement of the shaft arm 53 in the transport direction. And, the shaft arm 53 moves downstream in the transport direction along the D-A surface of the cam 54. Due to this movement of the shaft arm 53, the upper arm 51 and lower arm 52 connected to the shaft arm 53 retreat to the downstream side in the transport direction. And, the state becomes the retreat state shown in FIG. 9A, the sheet bundle B (sheets P) is stored, and the upper arm 51 and lower arm 52 wait until the binding operation is resumed. In this case, according to an operation in which the facing distance between the one end part 511 having the upper tooth 61 serving as the first pressing part and the one end part 521 of the lower arm 52 serving as the second pressing part increases, the upper arm 51 and lower arm 52 retreat more downstream than the pressing area.

As described above, the one end part 521 of the lower arm 52 functioning as the second pressing part, when or after it protrudes into the pressing area, is pushed out toward the one end part 511 of the upper arm 51 functioning as the first pressing part by the upper shaft lever 63 serving as the point of action.

Here, in the above-mentioned exemplary embodiments, the retreat operation of the binding unit 50 has been described on the assumption that, when the sheets P enter the sheet collecting part 70, the binding unit 50 retreats to the downstream side of the sheet collecting part 70. However, this retreat operation is performed also when the binding unit 50 moves in order to change a binding position. More specifically, after the sheet bundle B is stored into the sheet collecting part 70 serving as a storage unit, in a state where at least one of the first and second pressing parts retreats from the pressing area, the binding unit 50 changes its position with respect to the sheet collecting part 70.

Also, in the binding unit 50, the pushout link structure (pushout part) is formed of other member than the second pressing part and pushes out the second pressing part toward the first pressing part. And, the second pressing part is supported so as to be relatively movable with respect to the pushout link structure and pushes the sheet bundle B by a pressing force given from the pushout link structure. And, the second pressing part is pushed out in the pressing area in the pushout direction by the pushout link structure to press the sheet bundle B, is moved and retreated in a direction intersecting the pushout direction by an operation different from the operation of the pushout link structure, and, in pressing, is moved in a direction intersecting the pushout direction by an operation different from the operation of the pushout link structure, thereby moving into the pressing area.

In the foregoing description, various embodiments have been described, but these embodiments may also be combined with each other.

Also, the present disclosure is not limited to the above embodiments but the present disclosure may also be enforced in various embodiments without departing from the gist of the present disclosure.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A binding apparatus comprising:

a first pressing part that presses a recording material bundle for binding the recording material bundle;

a second pressing part that faces the first pressing part; and a pushout part that pushes out the second pressing part toward the first pressing part by acting on the second pressing part at a point of action and by varying a distance from a start portion serving as a start point of pushout movement to the point of action, wherein the start portion is formed integrally with a member at which the first pressing part is formed.

2. A binding apparatus according to claim 1, wherein the member at which the first pressing part is formed has the first pressing part at one end of the member and the start portion at other end of the member, the other end being opposite the one end.

3. A binding apparatus according to claim 1, wherein the member at which the first pressing part is formed rotates about a rotation shaft, and the first pressing part and the start portion are arranged at positions such that an imaginary line connecting the first pressing part and the rotation shaft and an imaginary line connecting the start portion and the rotation shaft intersect with each other.

4. A binding apparatus according to claim 2, wherein the member at which the first pressing part is formed rotates about a rotation shaft, and the first pressing part and the start portion are arranged at positions such that an imaginary line connecting the first pressing part and the rotation shaft and an imaginary line connecting the start portion and the rotation shaft intersect with each other.

5. A binding apparatus comprising:

a first pressing part that is formed at one end portion of an arm member for pressing a recording material bundle to bind the recording material bundle;

a second pressing part that faces the first pressing part; and a pushout part that pushes out the second pressing part toward the first pressing part, wherein the pushout part is supported by other end portion of the arm member, the other end portion extending in a curved manner integrally from the one end portion at which the first pressing part is formed.

6. A binding apparatus according to claim 5, wherein the arm member having the one end portion and the other end portion extending in a curved manner integrally from the one end portion is curved only at one position.

7. A binding apparatus according to claim 6, wherein the second pressing part is formed at one end portion of an arm structure, the arm structure having a rotation center at other end portion of the arm structure, and the arm member rotates about a same rotation shaft as the arm structure and intersects the arm structure.

8. An image processing apparatus comprising:

a transport unit that transports recording materials on which an image is formed;

a storage unit that stores a recording material bundle formed by bundling the recording materials transported by the transport unit; and a binding unit that binds the recording material bundle stored at the storage unit, wherein the binding unit comprises a first pressing part that is formed at one end portion of an arm member for pressing the recording material bundle to bind the recording material bundle, a second pressing part that faces the first pressing part, and a pushout part that pushes out the second pressing part toward the first pressing part, and the pushout part is supported by other end portion of the arm member, the other end portion extending in a curved manner integrally from the one end portion at which the first pressing part is formed.

* * * * *